US006314602B1

(12) United States Patent
Wallen

(10) Patent No.: US 6,314,602 B1
(45) Date of Patent: Nov. 13, 2001

(54) NON-SKIDDING VEHICLE WHEEL RAMP

(76) Inventor: Ronald J. Wallen, 105 N. 64th Dr., Phoenix, AZ (US) 85043

( * ) Notice: Subject to any disclaimer, the term of this patent is extended or adjusted under 35 U.S.C. 154(b) by 0 days.

(21) Appl. No.: 09/365,973

(22) Filed: Aug. 2, 1999

(51) Int. Cl.[7] ..... E01D 1/00; E02C 3/00; E01B 23/00

(52) U.S. Cl. ..... 14/69.5; 254/88; 238/14

(58) Field of Search ..... 14/69.5; 254/88; D34/32; 238/14

(56) References Cited

U.S. PATENT DOCUMENTS

| | | | | |
|---|---|---|---|---|
| 1,305,024 | * | 5/1919 | Taege . | |
| 1,519,334 | * | 12/1924 | Rolli | 238/14 |
| 1,871,129 | * | 8/1932 | Pierce . | |
| 2,184,061 | * | 12/1939 | Skroback . | |
| 2,420,130 | * | 6/1947 | Foss . | |
| 3,749,309 | * | 7/1973 | Becker | 238/14 |
| 3,870,277 | * | 3/1975 | West | 254/88 |
| 3,915,430 | * | 10/1975 | Chromy et al. | 254/88 |
| 4,058,292 | * | 11/1977 | Goodrich et al. | 254/88 |
| 4,133,480 | * | 1/1979 | Granryd | 238/14 |
| 4,461,456 | * | 7/1984 | Munna | 254/88 |
| 4,993,685 | * | 2/1991 | Sparling | 254/88 |
| 5,001,798 | * | 3/1991 | Hamilton | 14/69.5 |
| 5,118,081 | * | 6/1992 | Edelman | 254/88 |
| 5,156,238 | * | 10/1992 | Matthews | 187/8.72 |
| 5,503,368 | * | 4/1996 | Torres | 254/88 |
| 5,781,954 | | 7/1998 | Mayer | 14/69.5 |
| 5,863,026 | * | 1/1999 | Gano et al. | 254/88 |
| 5,947,448 | * | 9/1999 | Lewis et al. | 254/88 |
| 6,045,122 | * | 4/2000 | Torres | 254/88 |

* cited by examiner

*Primary Examiner*—Thomas B. Will
*Assistant Examiner*—Gary S. Hartmann
(74) *Attorney, Agent, or Firm*—Ellis Venable & Busam, L.L.P.

(57) ABSTRACT

A Non-Skidding Vehicle Wheel Ramp having a portable vehicle wheel ramp portion coupled to a portable anchor portion by a detachable linkage. The coupling of the portable vehicle wheel ramp portion and the portable anchor portion permits elevating a vehicle in a safe matter and the detachable linkage permits unencumbered access to the vehicle undercarriage.

11 Claims, 8 Drawing Sheets

NON-SKIDDING VEHICLE WHEEL RAMP

FIELD OF THE INVENTION

The present invention relates to vehicle ramps used for raising a vehicle and thereby allowing access to the underside of said vehicle.

BACKGROUND

Portable vehicle ramps allowing access to undercarriages are already known in prior art and are largely used when repairs are required underneath a vehicle. These ramps allow a user to raise either the front end or the back end of the vehicle. The ramps known in prior art are likely made of steel and comprise an elongated sloped portion connected to a tire platform portion. U.S. Pat. No. 5,781,954 issued to Mayer (hereinafter "Mayer '954") depicts a modification of a portable prior art car ramp.

One problem with encountered with prior art car ramps is the difficulty or danger encountered during the positioning of the vehicle on top of said prior art ramp. Generally, said prior art ramps are constructed of steel while the garage floor is smooth cement to facilitate the easy cleaning of spilled fluids. As a result, the union of the steel ramp and the cement floor will usually present insufficient friction to stop the ramp from skidding across the garage floor when one attempts to maneuver said vehicle onto said ramp. Accordingly, it would be desirable to have a non skidding vehicle ramp suitable for raising a wide variety of vehicles that is portable, easy to handle, safe for the user and low in cost.

SUMMARY OF THE INVENTION

The present invention relates more particularly to portable non skidding vehicle ramps used for raising a vehicle and thereby allowing access to the underside of said vehicle.

As can be appreciated, the portable non-skidding vehicle ramp according to the present invention provides a ramp suitable for lifting a wide variety of vehicles in manner that is safer than that afforded by traditional portable car ramps, but without the expense or inconvenience of permanently anchored vehicle ramps.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Figure 1:
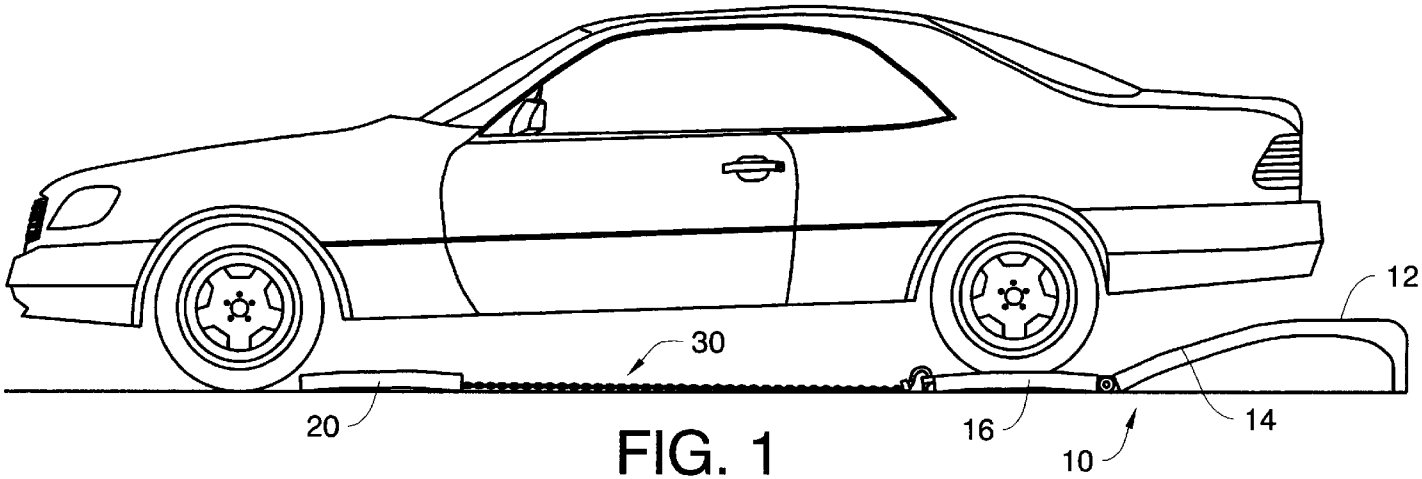
FIG. 1 depicts a side view of one embodiment of the present invention in use.
Figure 2:
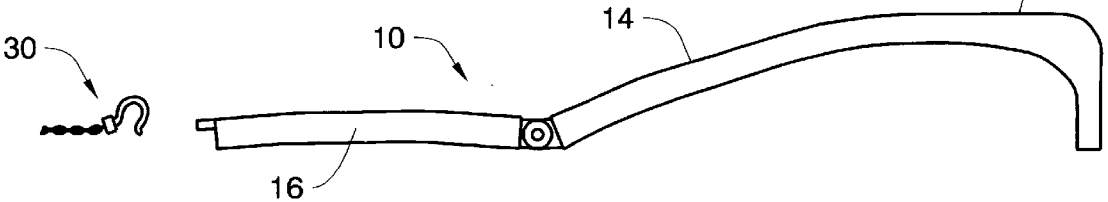
FIG. 2 depicts a side perspective close view of a portion of the present invention.
Figure 3:
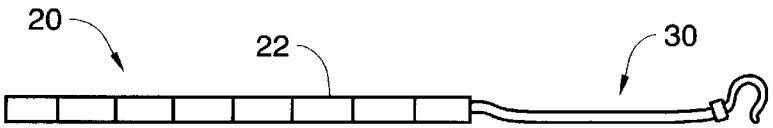
FIG. 3 depicts a side view of showing an alternate embodiment of a portion of the present invention.
Figure 4:
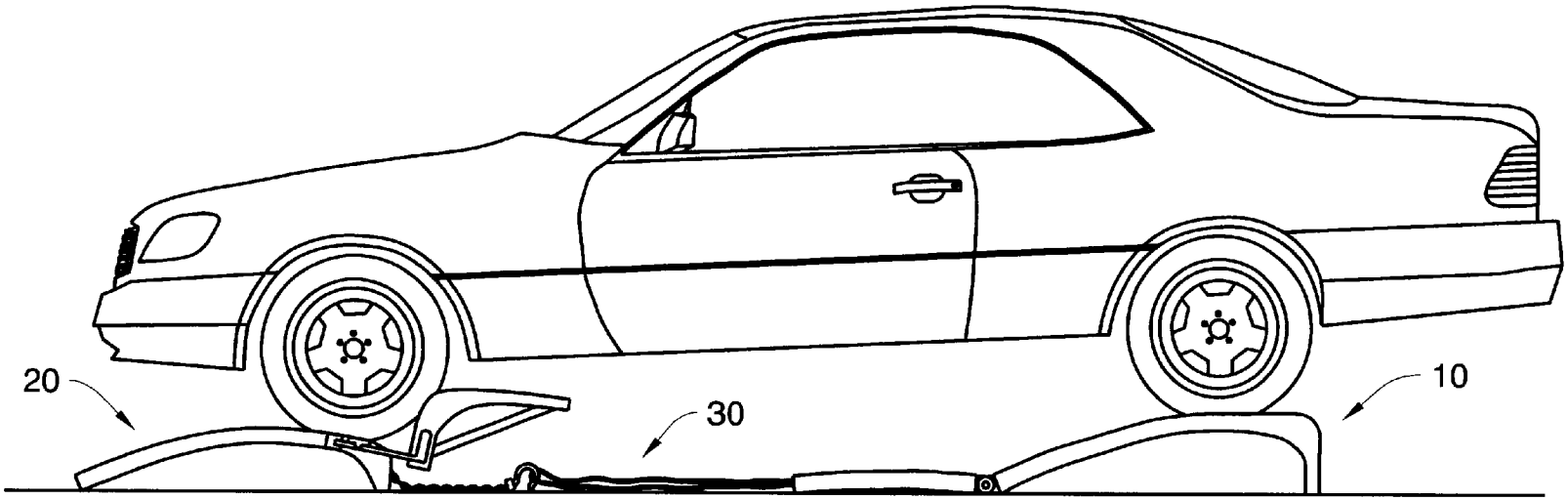
FIG. 4 depicts a side view of one embodiment of the present invention in use.
Figure 5:
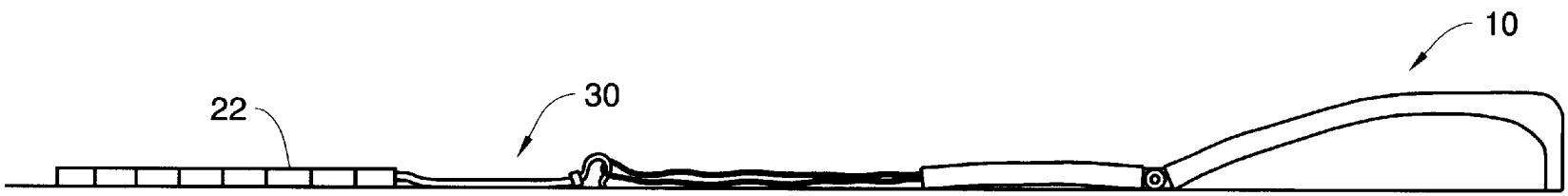
FIG. 5 depicts a side perspective view of an alternate embodiment of the present invention.

Referring to the figures, the present invention, a Non-Skidding Vehicle Wheel Ramp (1), comprises a portable vehicle wheel ramp portion (10) coupled to a portable anchor portion (20) by a linkage (30). Ramps (1) of the present invention are generally used in pairs to elevate a vehicle for access to the vehicle undercarriage.

The Ramps (1) are used to elevate a vehicle by positioning a pair of said Ramps (1) on a garage floor, with the portable vehicle wheel ramp portions (10) positioned adjacent to the vehicle rear tire treads and the portable anchor portions (20) positioned adjacent to the vehicle front tire treads. Next, said vehicle is driven until said front and rear vehicle wheels are maneuvered onto said portable vehicle wheel ramp portions (10) and said anchor portions (20). As a result, said vehicle is safely elevated for access to the vehicle undercarriage.

This method of raising a vehicle is safer than that ordinarily permitted from ordinary car ramps because said ramp portion (10) and said anchor portion (20) are coupled together. Therefore, all of the vehicle weight will be distributed between said ramp portion (10) and said anchor portion (20), and accordingly, the Ramp (1) will not slip on the garage floor.

All embodiments of the portable vehicle tire ramp portion (10) are preferably made of a high strength metal. One embodiment of said ramp portion (10) comprises a raised platform portion (12) connected to an elongated sloped portion (14). The elongated sloped portion (14) provides the access to the raised platform portion (12) that is adapted to support a vehicle wheel in the static elevated position. Said ramp portion (10) and said sloped portion (14) are constructed having sufficient rigidity to support a portion of the vehicle weight as is common in the art of ordinary vehicle ramps. Moreover, the ramp portion (10) is provided along its sloped portion (14) and platform portion (12) with tire stabilizer edges (18) connected both sides of said sloped portion (14) to receive and guide said vehicle wheel onto the platform portion (14) and further provide added stability.

Figure 6:
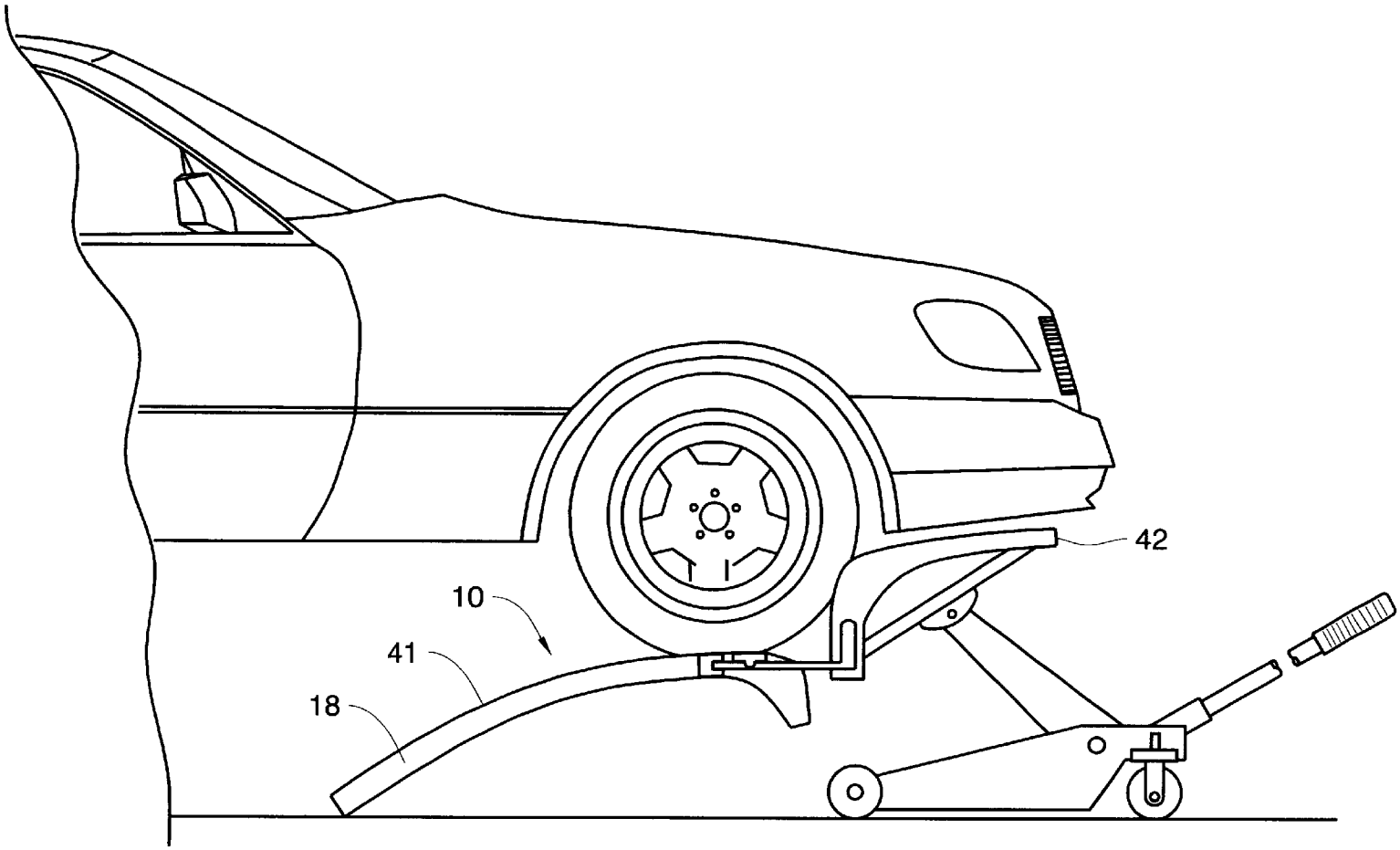
FIG. 6 depicts a side view of a portion of the preferred embodiment using a floor jack.

It Another embodiment of said ramp portion (10) comprises a vehicle tire runway (41) coupled to a jack adapter (42) having a jack head receptacle (44). This embodiment of the ramp portion (10) permits a low profile vehicle to be lifted by an ordinary floor jack. See FIG. 6. Said vehicle tire runway (41) is adapted to support a vehicle wheel in a static elevated height sufficient to enable the positioning of an ordinary floor jack either underneath a low profile vehicle undercarriage or underneath the jack head receptacle (44). The static elevated height of the vehicle tire runway (41) is preferably between three and six inches. The jack adapter (42) is coupled to one distal end of said vehicle tire runway (41) and is further adapted to brace said vehicle tire and also receive the head of an ordinary floor jack. The preferred jack head receptacle (44) includes a jack piston socket (43) that is particularly adapted to receive the head of ordinary floor jack without slippage. Moreover, said vehicle tire runway (41) and said jack adapter (42) are preferably detachably coupled together by brackets (45) on the vehicle tire runway (41) that are adapted to receive and support forks (44) on the jack adapter (42). Tire stabilizer edges (18) are also connected both sides of said vehicle tire runway (41) to receive and guide said vehicle wheel onto the jack adapter (42) and further provide added stability.

Another embodiment of said vehicle tire ramp portion (10) further comprises a folding ramp portion (16) that is hingedly connected to said portable vehicle tire ramp portion (10) and provides a runway for said vehicle wheel while permitting more compact storage capability. Moreover, each ramp portion (10) may be optionally equipped with removably attachable base (50) that discourage said ramp portion (10) from sinking into a soft surface supporting the Ramps (1) and a vehicle supported thereon.

The portable anchor portion (20) has two preferred embodiments. In one embodiment, said portable anchor portion (20) comprises a substantially flat mat (22). In another embodiment, said anchor portion (20) comprises a second portable vehicle tire ramp portion (10). In the former embodiment of the anchor portion (20), said mat (22) is connected to said wheel ramp portion (10) by said linkage (30) and receives a substantial portion of the weight of said vehicle to prevent slippage of the Ramp (1) on the garage floor. In the latter embodiment, the second portable vehicle tire ramp portion (10) enables also receives a substantial portion of the weight of said vehicle to prevent slippage of the Ramp (1) on the garage floor but further provides elevation to that portion of the vehicle supported thereupon. However, in both embodiments, the anchor portion (20) is slightly longer than the ramp portion (10) to ensure that either the front tire pair or the rear tire pair is positioned on the anchor portion (20) before the second tire pair encounters said ramp portion (1 0).

The linkage (30) of the Ramp (1) is preferably flexible and strong and the preferred material of construction is chain, nylon ribbon, or steel cable. Moreover, each material above is constructed in the manner ordinary in the art of making towing chains, straps or cable to have sufficient strength to ensure that said linkage (30) does not break under the straining force encountered when a vehicle is maneuvered onto or off of the Ramps (1). In the preferred embodiment of said Ramp (1), said linkage (30) is further detachably connectable from at least said portable vehicle tire ramp portion (10), or from said portable anchor portion (20), to permit unencumbered access to the undercarriage of said vehicle.

Figure 7:
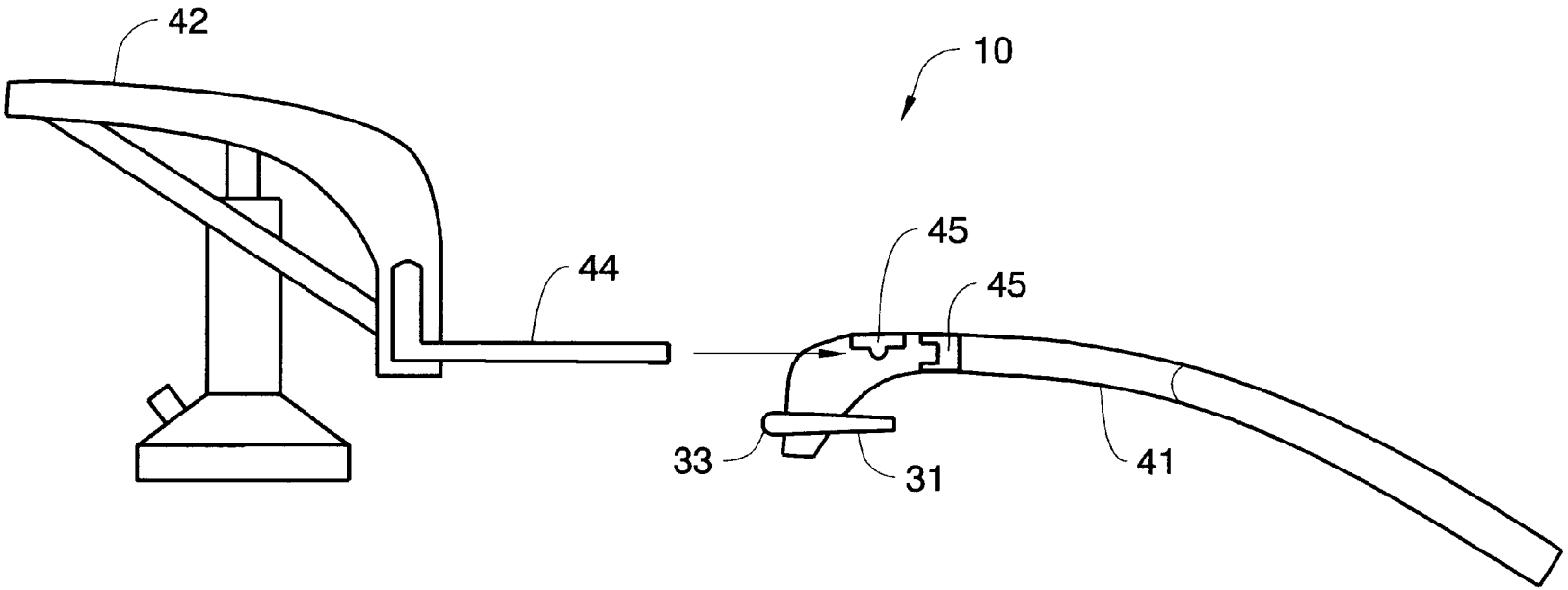
FIG. 7 depicts a close side view of the preferred embodiment with a floor jack.
Figure 8:
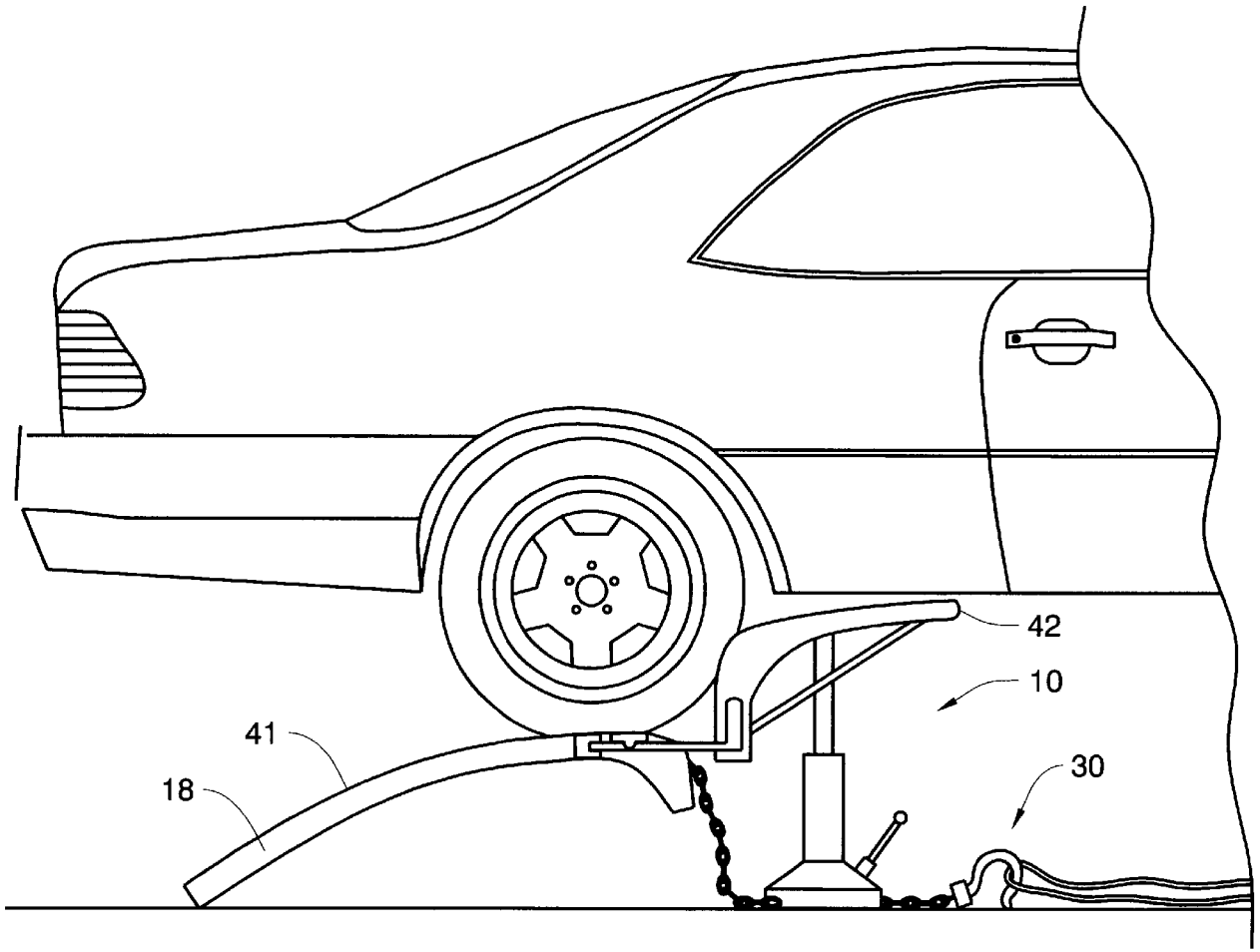
FIG. 8 depicts a side perspective view showing the preferred embodiment in use with a floor jack.
Figure 9:
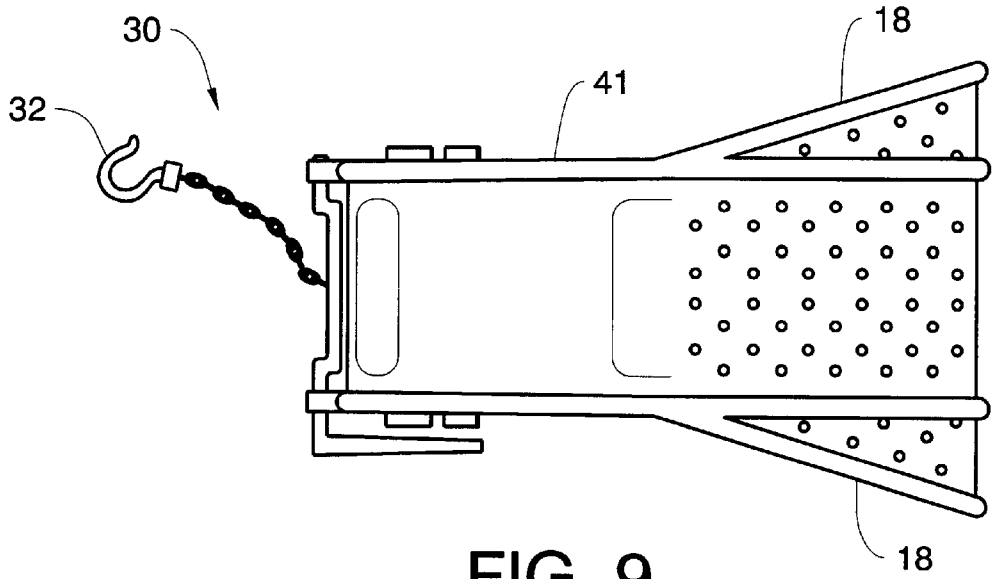
FIG. 9 depicts top view of a portion of the preferred embodiment.
Figure 11:
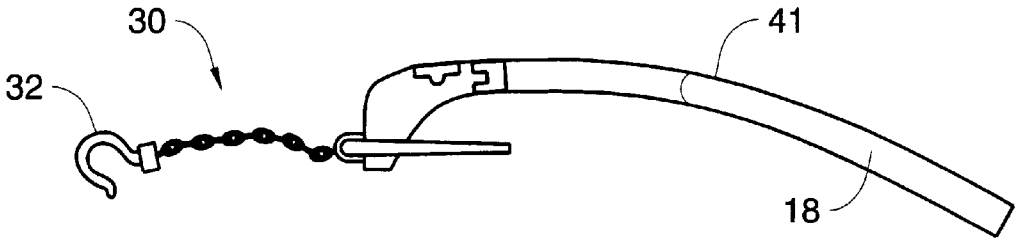
FIG. 11 depicts a side perspective of the a portion of the preferred embodiment.
Figure 10:
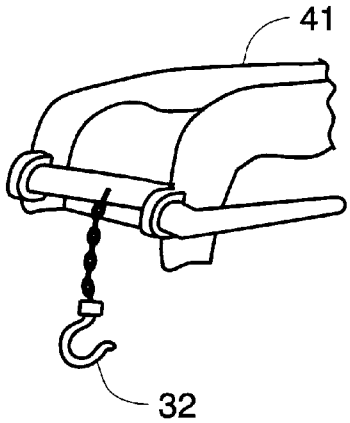
FIG. 10 depicts a side perspective of the a portion of the preferred embodiment.
Figure 12:
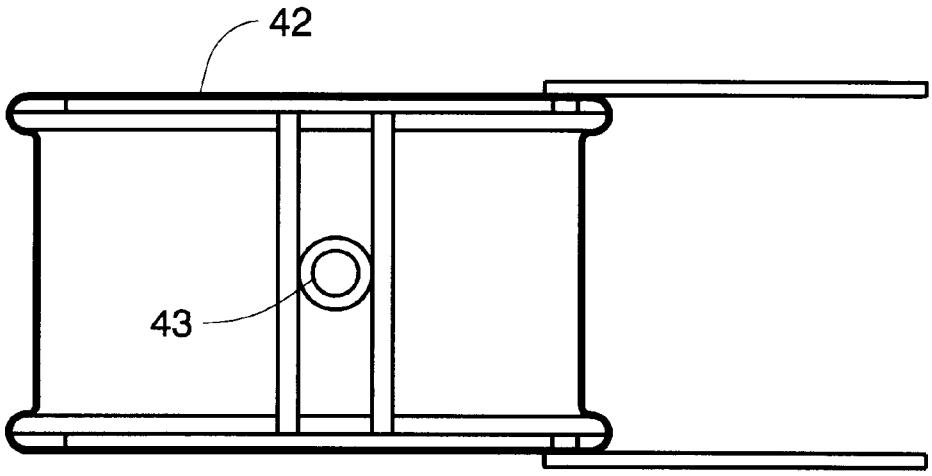
FIG. 12 depicts a side view of a portion of the preferred embodiment.
Figure 13:
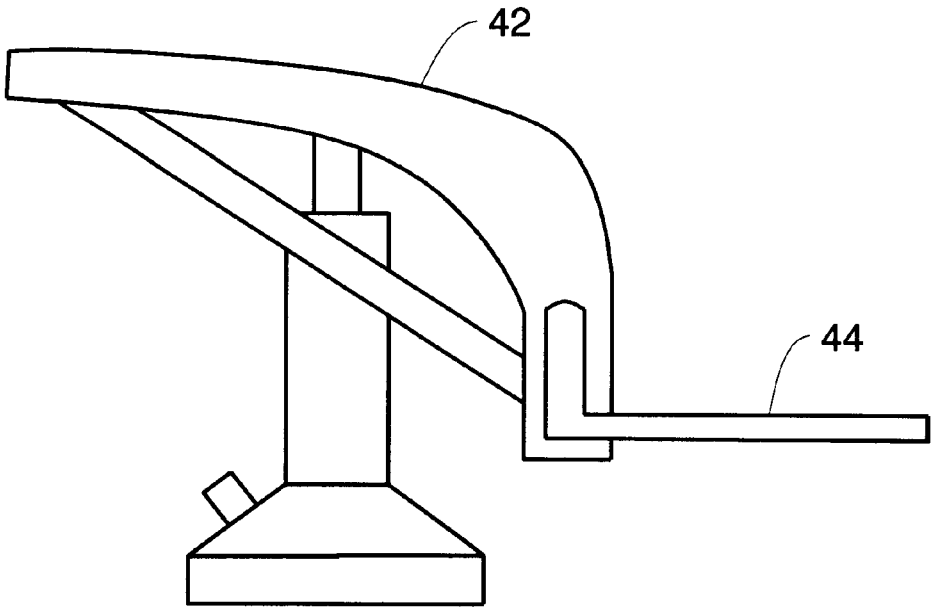
FIG. 13 depicts a side view of a portion of the preferred embodiment.
Figure 14:
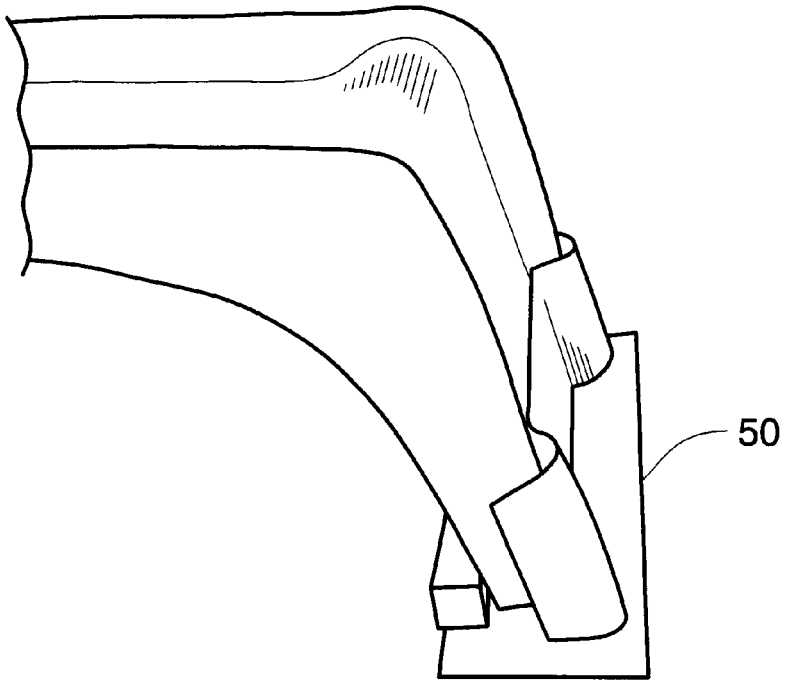
FIG. 14 depicts a perspective view of the removably attachable base of the present invention.
Figure 15:
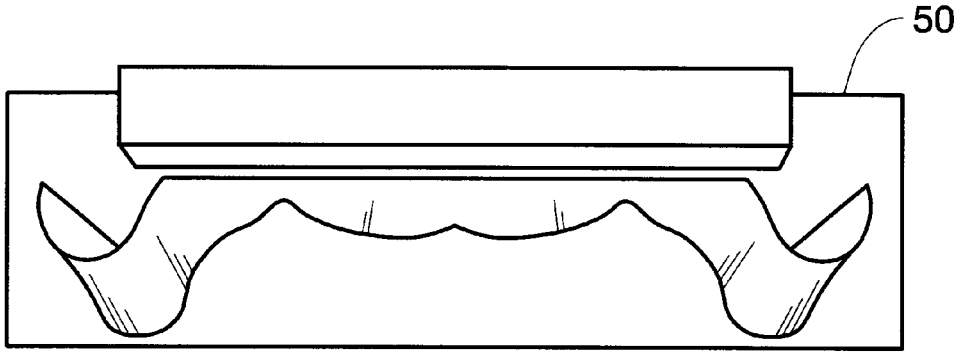
FIG. 15 depicts a top view of the removably attachable base of the present invention

Said linkage (30) can be made detachably connectable by any manner ordinary in the art that enables detaching a connecting linkage or chain that is under a static condition of tension. On such structure is depicted in FIG. 7. Said structure is a linkage tension release lever (31) comprising; a substantially "U-shaped" rod (33), rotatably coupled at distal ends to either said ramp portion (10) or said portable anchor portion (20) and adapted to be rotated by hand. Said linkage tension release lever (31) is used in combination with a hook (32) coupled to said linkage (30).

In use, said hook (32) is "hooked" onto said rod (33) to couple said ramp portion (10) to said portable anchor portion (20). Next, the vehicle is maneuvered onto said Ramps (1) in the manner previously described above. To enable unencumbered access to the vehicle undercarriage said linkage tension release lever (31) is rotated thereby effectively lengthening the linkage (30). The lengthening of said linkage (30) enables disengaging the hook (32) coupling said linkage (30) between said ramp portion (10) and said portable anchor portion (20). After the hook (32) is disengaged, said linkage (30) can be moved from under the vehicle undercarriage. When it is desired to bring the vehicle down off the Ramps (1), said ramp portion (10) and said portable anchor portion (20) can be coupled together again by said linkage (30).

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. An apparatus for lifting both axles of a vehicle, comprising:

a) a first portable vehicle tire ramp portion, attachable at a distance, that is substantially the vehicle wheelbase length to;

b) a second portable vehicle tire ramp portion, by;

c) a linkage; and at least one of said portable vehicle tire ramp portions further comprises:

i) a vehicle tire runway providing a static elevated position coupled to;

ii) a jack adapter, laterally displaced from the static elevated platform and having a floor jack head receptacle that is adapted to receive a floor jack head at a position that is elevated relative to the elevated platform.

2. The apparatus in claim 1 wherein at least one of said first and second portable vehicle tire ramp portions further comprises:

a) a raised platform portion connected to;

b) an elongated sloped portion.

3. The apparatus in claim 1 wherein at least one of said portable vehicle tire ramp portions further comprises at least two tire stabilizer edges connected to both sides of said vehicle tire ramp portion, whereby said tire stabilizer edges are adapted to guide and secure a vehicle tire onto said vehicle tire ramp portion and provide stability.

4. The apparatus in claim 1 wherein said first portable vehicle tire ramp portion is coupled to said second portable vehicle tire ramp portion by a substantially flat mat.

5. An apparatus for adapting a floor jack to lift a low profile vehicle, comprising:

a) a vehicle tire runway fixedly attached to an elevated platform, the combination of the vehicle tire runway and elevated platform coupled to;

b) a jack adapter, laterally displaced from the static elevated platform and having a floor jack head receptacle that is adapted to receive a floor jack head at a position that is elevated relative to the elevated platform.

6. The apparatus in claim 5 wherein said combination of the vehicle tire runway and elevated platform further includes a base edge, and the static elevated platform is displaced less than ten inches from the base edge.

7. The apparatus in claim 5 wherein said floor jack head receptacle further comprises a jack piston socket that is adapted to receive the head of the floor jack without slippage.

8. The apparatus in claim 5 wherein said combination of the vehicle tire runway and elevated platform is detachably coupled to the jack adapter by brackets on the combination of the vehicle tire runway and static elevated platform that are adapted to receive and support forks on the jack adapter.

9. The apparatus in claim 5 further comprising an anchoring structure attachable to the vehicle tire runway and adapted to hold the vehicle tire stationary using the weight of a vehicle.

10. The apparatus in claim 9 wherein the anchoring structure comprises a wheel mat, the wheel mat coupled to the vehicle tire runway by a linkage.

11. The apparatus in claim 10 wherein the linkage is detachable from the vehicle tire runway.

* * * * *